US007736094B1

(12) United States Patent
Bianchi et al.

(10) Patent No.: US 7,736,094 B1
(45) Date of Patent: Jun. 15, 2010

(54) SELF-CONTAINED BURYING DEVICE FOR SUBMERGED ENVIRONMENTS

(75) Inventors: Josh Bianchi, San Diego, CA (US); Timothy J. Keenan, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 2 days.

(21) Appl. No.: 12/391,986

(22) Filed: Feb. 24, 2009

(51) Int. Cl.
*B63B 21/26* (2006.01)

(52) U.S. Cl. ..... 405/224.1; 405/226; 114/295

(58) Field of Classification Search ..... 405/224, 405/224.1, 226, 259.1; 114/294, 295, 296
See application file for complete search history.

(56) References Cited

U.S. PATENT DOCUMENTS

| | | | | | |
|---|---|---|---|---|---|
| 3,118,417 | A | * | 1/1964 | Stanwick | 405/224 |
| 3,417,724 | A | * | 12/1968 | Edwards | 114/295 |
| 3,850,128 | A | | 11/1974 | Lovell | |
| 3,910,218 | A | * | 10/1975 | Taylor et al. | 114/295 |
| 4,086,866 | A | | 5/1978 | Nixon et al. | |
| 4,095,550 | A | | 6/1978 | Kerr | |
| 4,114,390 | A | | 9/1978 | Van Steveninck et al. | |
| 4,257,721 | A | * | 3/1981 | Haynes | 405/224 |
| 4,347,802 | A | * | 9/1982 | Hossfeld | 114/295 |
| 4,566,367 | A | | 1/1986 | Hickey et al. | |
| 4,576,521 | A | * | 3/1986 | Conrad | 405/226 |
| 4,586,421 | A | | 5/1986 | Hickey et al. | |
| 4,648,745 | A | | 3/1987 | Hulsbergen | |
| 4,761,096 | A | | 8/1988 | Lin | |
| 4,817,734 | A | * | 4/1989 | Kuehn | 405/228 |
| 4,877,353 | A | * | 10/1989 | Wisotsky, Sr. | 405/228 |
| 4,991,997 | A | | 2/1991 | Cowper | |
| 5,088,565 | A | | 2/1992 | Evarts | |
| 5,794,716 | A | | 8/1998 | White | |
| 6,116,818 | A | | 9/2000 | Bitetti | |
| 6,941,885 | B2 | | 9/2005 | Zimmerman et al. | |
| 2006/0159522 | A1 | | 6/2006 | Edfeldt | |

* cited by examiner

*Primary Examiner*—Frederick L Lagman
(74) *Attorney, Agent, or Firm*—Ryan J. Friedl; Kyle Eppele

(57) ABSTRACT

A system includes a body portion having rear portion having a fluid intake port and a nose portion having a fluid discharge port. The body portion contains an omni-directional vibratory device, a pump, a fluid conduit that is coupled to the pump and the fluid discharge port, and a power source that is electrically connected to the vibratory device and the pump. The body portion may also contain control circuitry and two end caps rigidly fixed therein, wherein the fluid conduit passes through each end cap. The vibratory device and the pump may be activated by a sensor such as a hydrostatic pressure sensor, an accelerometer, or an altimeter. The body portion may also contain communications circuitry that remotely controls the vibratory device and the pump. The body portion is configured to house a payload such as a sensor system, a battery pack, or a ballast for anchoring.

20 Claims, 7 Drawing Sheets

FIG.10A
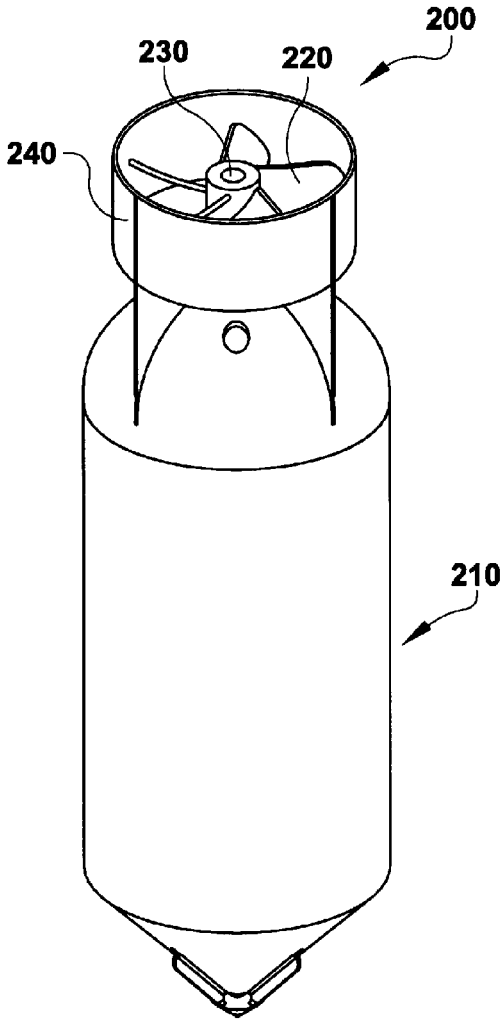
FIG.10B
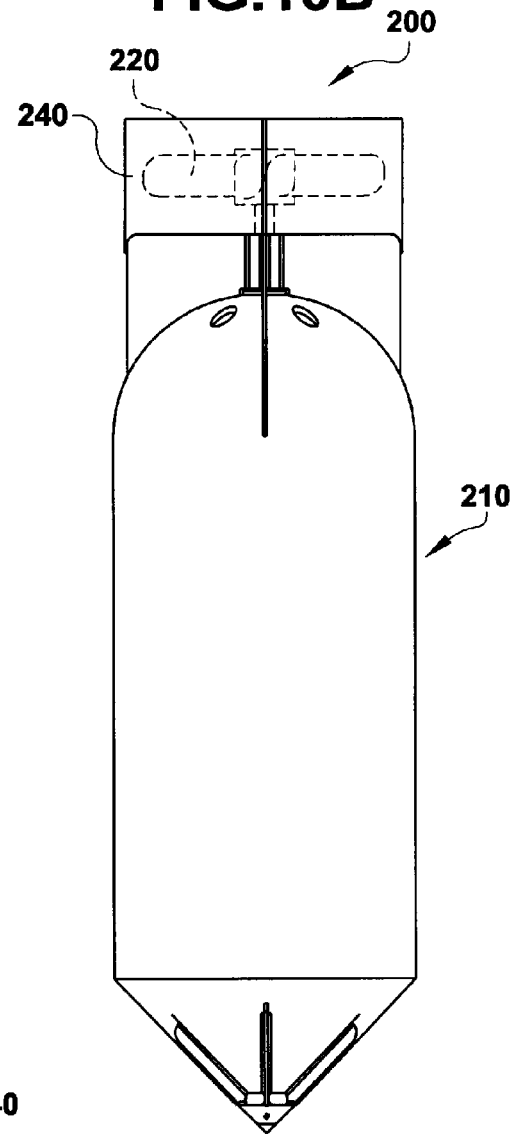
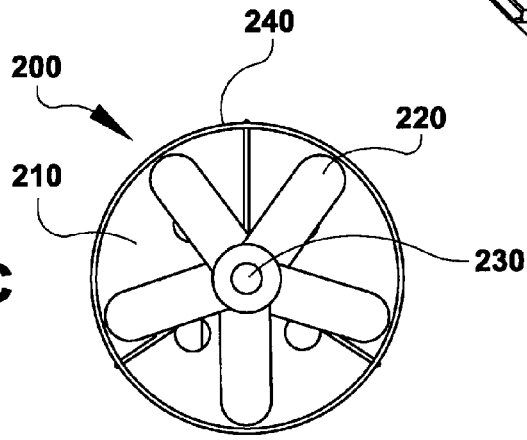
FIG.10C

SELF-CONTAINED BURYING DEVICE FOR SUBMERGED ENVIRONMENTS

FEDERALLY SPONSORED RESEARCH AND DEVELOPMENT

The Self-Contained Burying Device for Submerged Environments is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case No. 99651.

BACKGROUND

Some submerged-based applications require a device to be buried in the sea floor. An example of one such application is an anchor for various buoys types, offshore platforms, or navigational nodes for unmanned underwater vehicles. It is often desirable to entirely embed a device into the sea floor to conceal the device and/or prolong the survivability of the device by protecting it from the harsh submerged environment. Currently existing burying devices are not self-contained and do not have the capabilities to house a payload or be remotely controlled. Such features are useful and desirable in many commercial and military applications operating in marine environments. A need exists for a burying device having such features.

BRIEF DESCRIPTION OF THE DRAWINGS

FIG. 10A shows a perspective view of an embodiment of a system containing a propellant attached thereto, in accordance with the Self-Contained Burying Device for Submerged Environments.

FIG. 10B shows a side view of an embodiment of a system containing a propellant attached thereto, in accordance with the Self-Contained Burying Device for Submerged Environments.

FIG. 10C shows a top view of an embodiment of a system containing a propellant attached thereto, in accordance with the Self-Contained Burying Device for Submerged Environments.

DETAILED DESCRIPTION OF SOME EMBODIMENTS

Figure 1:
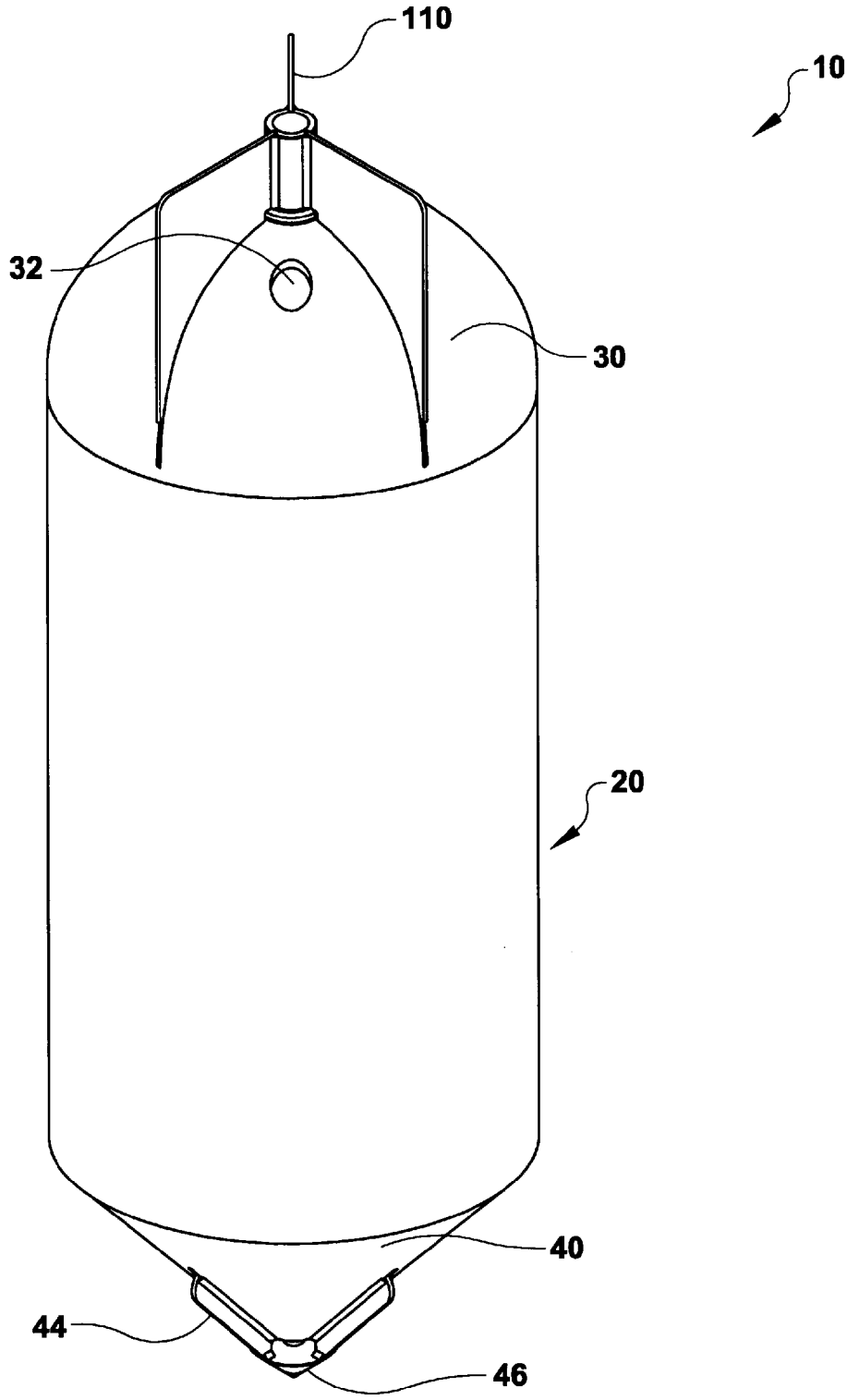
FIG. 1 shows a perspective view of one embodiment of a system in accordance with the Self-Contained Burying Device for Submerged Environments.
Figure 2:
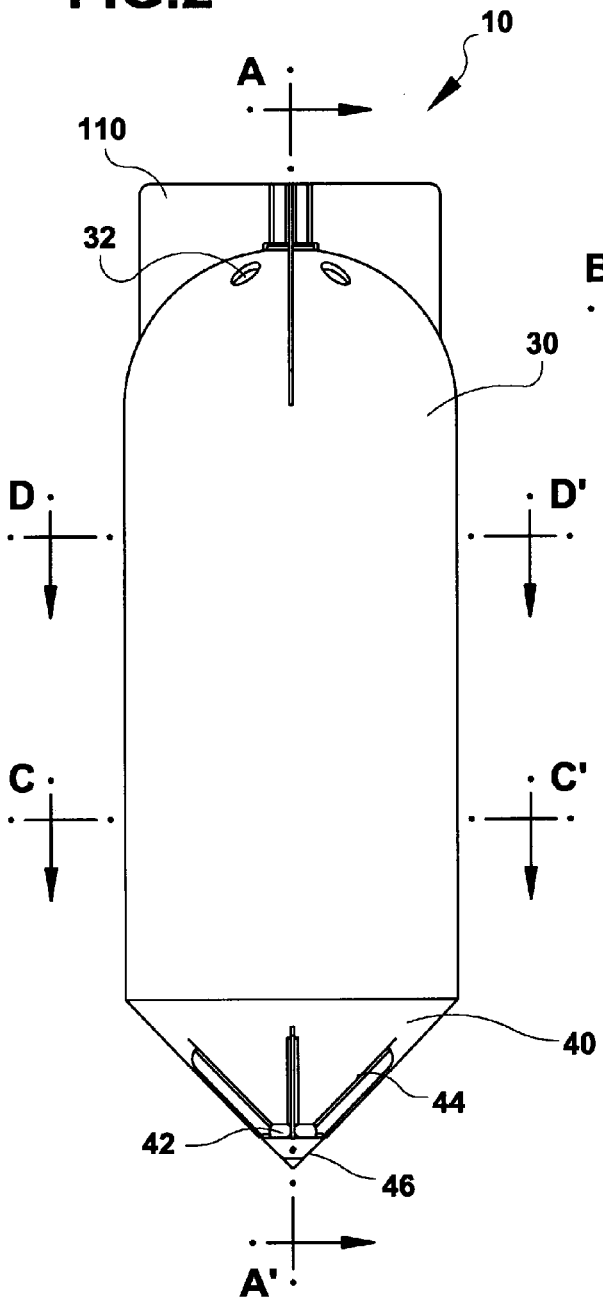
FIG. 2 shows a front view of the embodiment of the system shown in FIG. 1.
Figure 3:
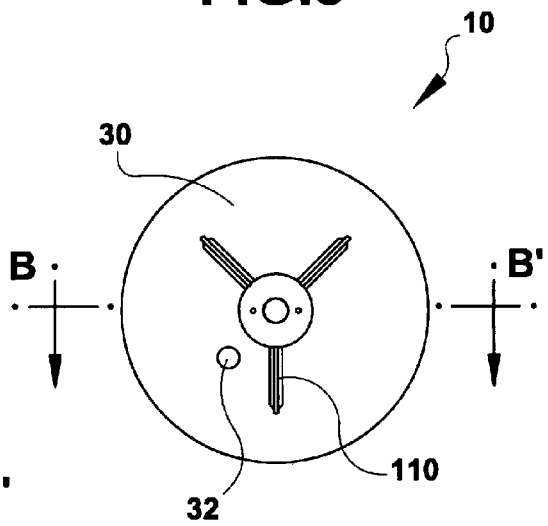
FIG. 3 shows a top view of the embodiment of the system shown in FIG. 2.
Figure 4:
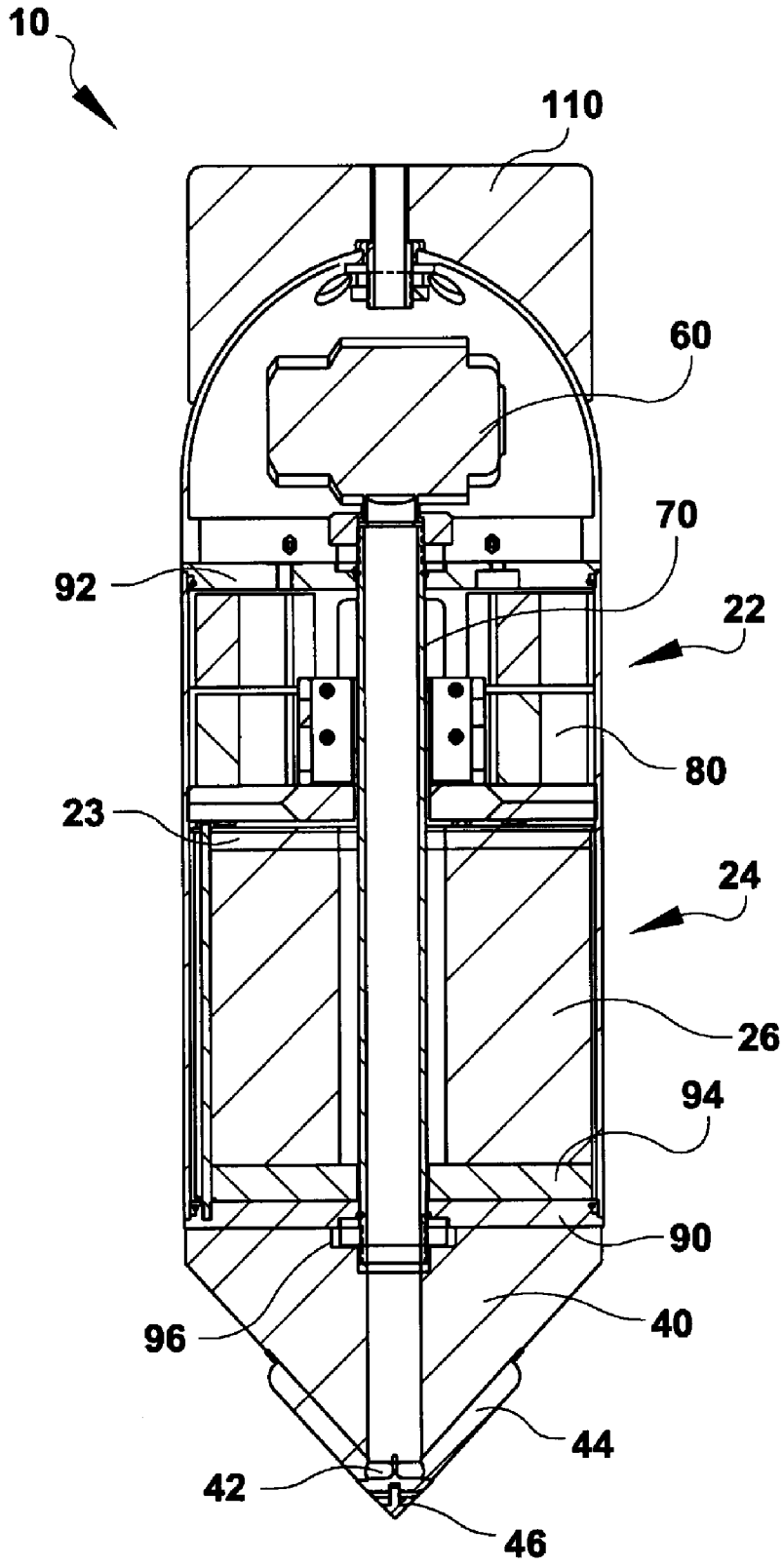
FIG. 4 shows a cross-section view of the embodiment of the system along line A-A' shown in FIG. 2.
Figure 5:
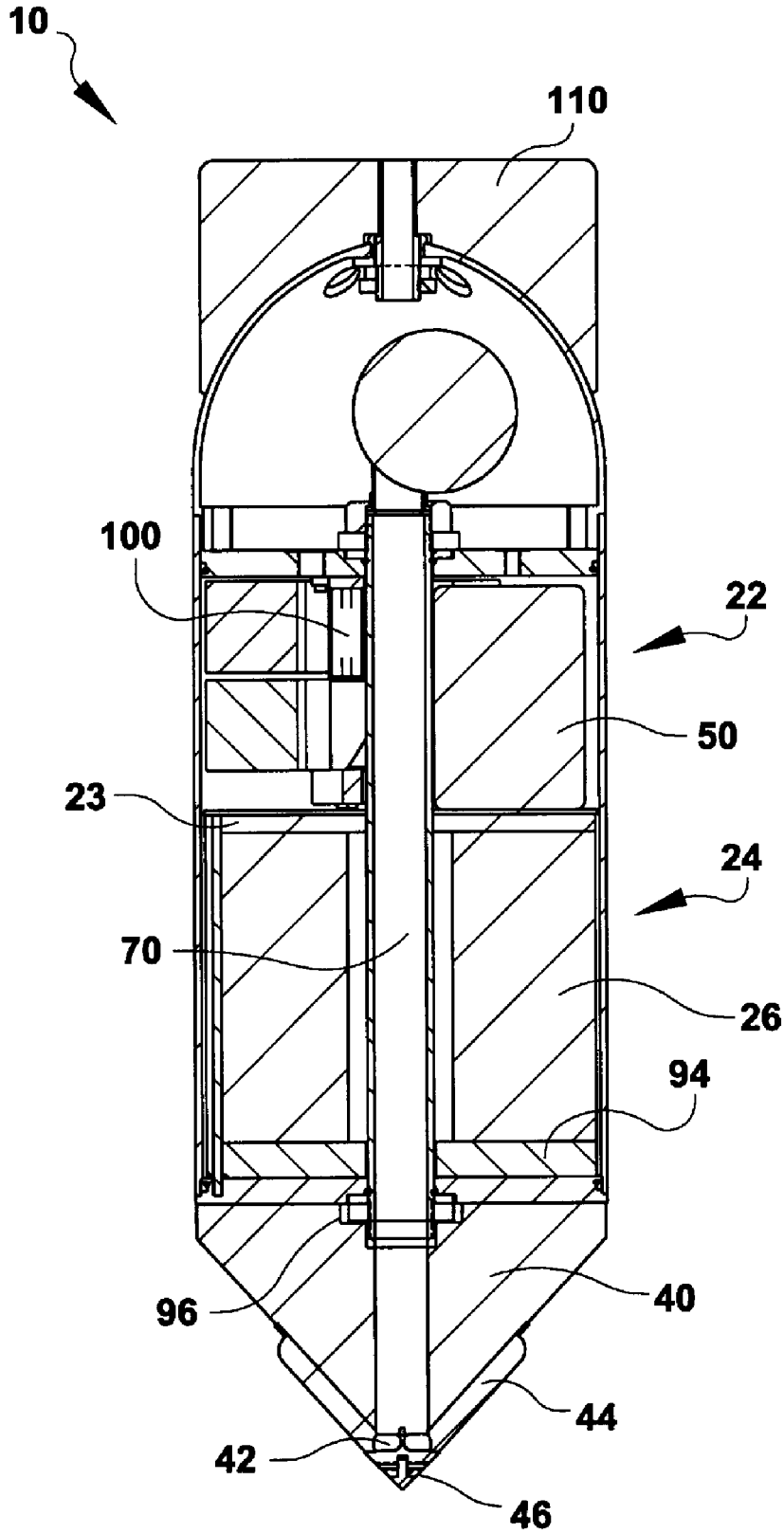
FIG. 5 shows a cross-section view of the embodiment of the system along line B-B' shown in FIG. 3.
Figure 6:
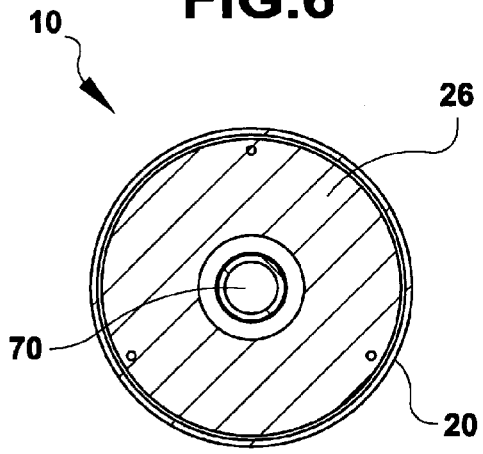
FIG. 6 shows a cross-section view of the embodiment of the system along line C-C' shown in FIG. 2.
Figure 7:
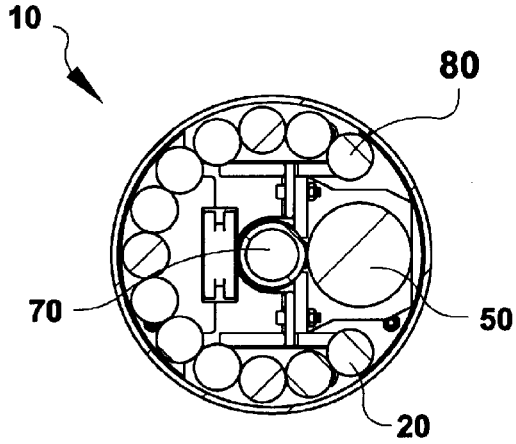
FIG. 7 shows a cross-section view of the embodiment of the system along line D-D' shown in FIG. 2.

FIG. 1 shows a perspective view of one embodiment of a system 10 in accordance with the Self-Contained Burying Device for Submerged Environments. System 10 may include a body portion 20, a rear portion 30, and a non-perforated nose portion 40. In some embodiments, rear portion 30 and nose portion 40 are a part of body portion 20. In such embodiments, body portion 20 forms one continuous structure, with the structure having a rear portion 30 having a fluid intake port 32 and a nose portion 40 having a fluid discharge port 42 (see FIG. 2). In other embodiments, rear portion 30 and nose portion 40 comprise separate components and are coupled to body portion 20. Such coupling may occur by various means, such as by set screws, or with other well-known connectors. Body portion 20, rear portion 30, and nose-portion 40 may be comprised of non-corrosive materials including metals, plastics, ceramics, and composite materials.

Body portion 20 may be shaped such that it can readily descend to, and rapidly bury into, the sea floor. As an example, body portion 20 may have an elongated cylindrical shape. In other embodiments, body portion 20 may comprise other shapes as recognized by one having ordinary skill in the art, such as bodies with increased surface area for greater anchoring strength. Fluid intake port 32 may be located at various locations along rear portion 30, so long as the opening is unobstructed from fluid flow. In some embodiments, rear portion 30 contains multiple fluid intake ports 32.

Referring to FIGS. 2-8, body portion 20 is configured to house a payload 26, such as a sensor system, a battery pack, or ballast for anchoring. Such a configuration may include fully enclosing payload 26 and preventing fluid from contacting payload 26. In some embodiments, the pressure boundary may be achieved by the outer structure of body portion 10. In other embodiments, the configuration may be achieved by structure contained within body portion 10, such as inner walls, end caps, or combinations thereof. In some embodiments, payload 26 is shock mounted, such that it can withstand a predetermined amount of impact. For example, in such embodiments, payload 26 may be cushioned with a viscoelastic material or other shock dampening mechanism.

In some embodiments, body portion 20 is separated into a first compartment 22 and a second compartment 24, with compartments 22 and 24 being impermeable to fluid. Such separation may be achieved by a divider 23 disposed within body portion 20. In some embodiments, divider 23 is coupled to body portion 20. Rear portion 30 may be coupled to first compartment 22 and be in alignment with body portion 20 and nose portion 40 may be coupled to second compartment 26 and be in alignment with body portion 20. In embodiments of system 10 where body portion is separated into a first compartment 22 and a second compartment 24, payload 26 may be contained within second compartment 24.

Nose portion 40 contains a fluid discharge port 42. In some embodiments, nose portion 40 contains multiple fluid discharge ports 42. In embodiments wherein nose portion 40 is conical in shape, fluid discharge port 42 may be located near the vertex thereof. In other embodiments, nose portion 40 may have other shapes as recognized by one having ordinary skill in the art. As an example, nose portion 40 may be hemispherical in shape. The placement of fluid discharge port 42 in such embodiments may vary depending on the particular design of nose portion 40.

In some embodiments, nose portion 40 contains at least three fins 44. A tip structure 46 may be coupled to fins 44 such that tip structure 46 is in alignment with fluid discharge port 40. Tip structure 46 helps prevent fluidized sediment from entering into fluid discharge port 40. Fins 44 also help to separate tip structure 46 from fluid discharge port. Such separation allows for fluid to readily exit fluid discharge port 40 and be dispersed into the sea floor surrounding nose portion 40 to fluidize the surrounding sediment. Such fluidization of the sediment surrounding nose portion 40 allows system 10 to more readily and rapidly bury into the sea floor. Fins 44 also allow the system to maintain a vertical stance and resist pull-out after burial.

Figure 8:
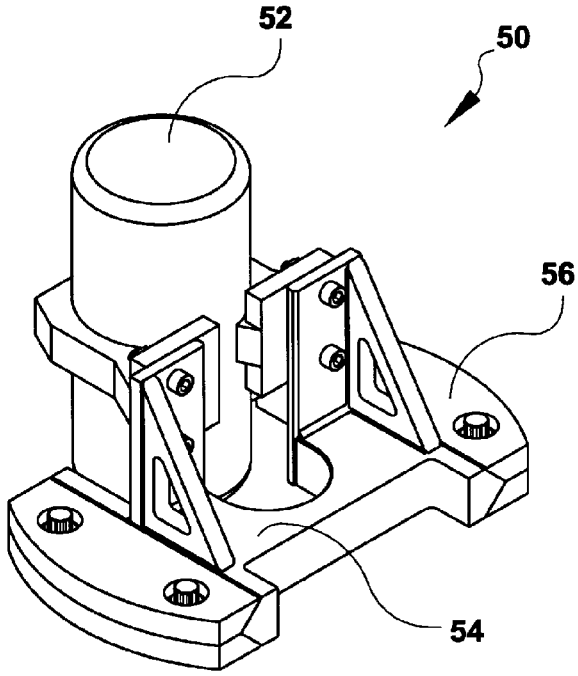
FIG. 8 shows a perspective view of one embodiment of a vibratory device for use with a system in accordance with the Self-Contained Burying Device for Submerged Environments.

Body portion 20 contains an omni-directional vibratory device 50. In embodiments of system 10 containing a first compartment 22 and a second compartment 24, vibratory device 50 may be contained within first compartment 22. Such a configuration may allow for more vibratory force to be employed by system 10 during burial. An example of an omni-directional vibratory device 50 is shown in FIG. 8. As shown, vibratory device 50 includes a vibration member 52, bracket 54, and wedge 56. Bracket 54 may be fixed to body portion 20 by bolting, welding, press fitting, thermal fitting, or other methods as recognized by one having ordinary skill in the art. Wedge 56 serves to rigidly fix the bracket 54 to body portion 20. Vibratory device 50 operates by the rotation of eccentric masses mounted to a DC electric motor.

A pump 60 may be contained within rear portion 30. Pump 60 may be a centrifugal pump, an example of which may be commercially obtained from the ITT Corporation, model Rule 3700 16A. Vibratory device 50 and pump 60 may be activated by a sensor contained within body portion 20, such as a hydrostatic pressure sensor, an accelerometer, altimeter, or mechanical trigger. In embodiments of system 10 containing a first compartment 22 and a second compartment 24, the sensor may be contained within first compartment 22.

A fluid conduit 70 may be contained within body portion 20 and nose portion 40. Fluid conduit 70 may be coupled to pump 60 and fluid discharge port 46. In some embodiments, fluid conduit 70 is removable from within body portion 20. In other embodiments, fluid conduit 70 is a structural member within body portion 20. In such embodiments, fluid conduit 70 may be used to tie caps at opposite ends of body portion 20. Fluid conduit 70 may center annular end caps 92 and 90 and prohibit their movement along the axis of body portion 20. System 10 may also contain a power source 80 located within body portion 20. Power source 80 may be electrically connected to vibratory device 50 and pump 60. In embodiments of system 10 containing a first compartment 22 and a second compartment 24, power source 80 may be contained within first compartment 22. Body portion 20 may also contain two end caps 90 and 92 rigidly fixed therein, wherein fluid conduit 70 passes through each end cap 90 and 92. End caps 90 and 92 may serve to stabilize fluid conduit 70 within body portion 20. In some embodiments, power source 80 comprises a battery pack. In other embodiments, power source 80 comprises a fuel cell, or other energy transferring device.

Body portion 20 may also contain communication and control circuitry 100 therein. Circuitry 100 allows for vibratory device 50 and pump 60 to be remotely controlled. In embodiments of system 10 containing a first compartment 22 and a second compartment 24, circuitry 100 may be contained within first compartment 22. In embodiments having a remote communication capability, a sensor may transfer signals to circuitry 100, such signals used to control vibratory device 50 and pump 60.

Body portion may have fins 110 coupled thereto to aid in stabilizing system 10. In some embodiments, fins 110 may be attached to rear portion 30. In other embodiments, fins may be attached to body portion 20. Depending on the design of system 10, body portion 20 may have one fin 110 or multiple fins 110 coupled thereto.

Figure 9:
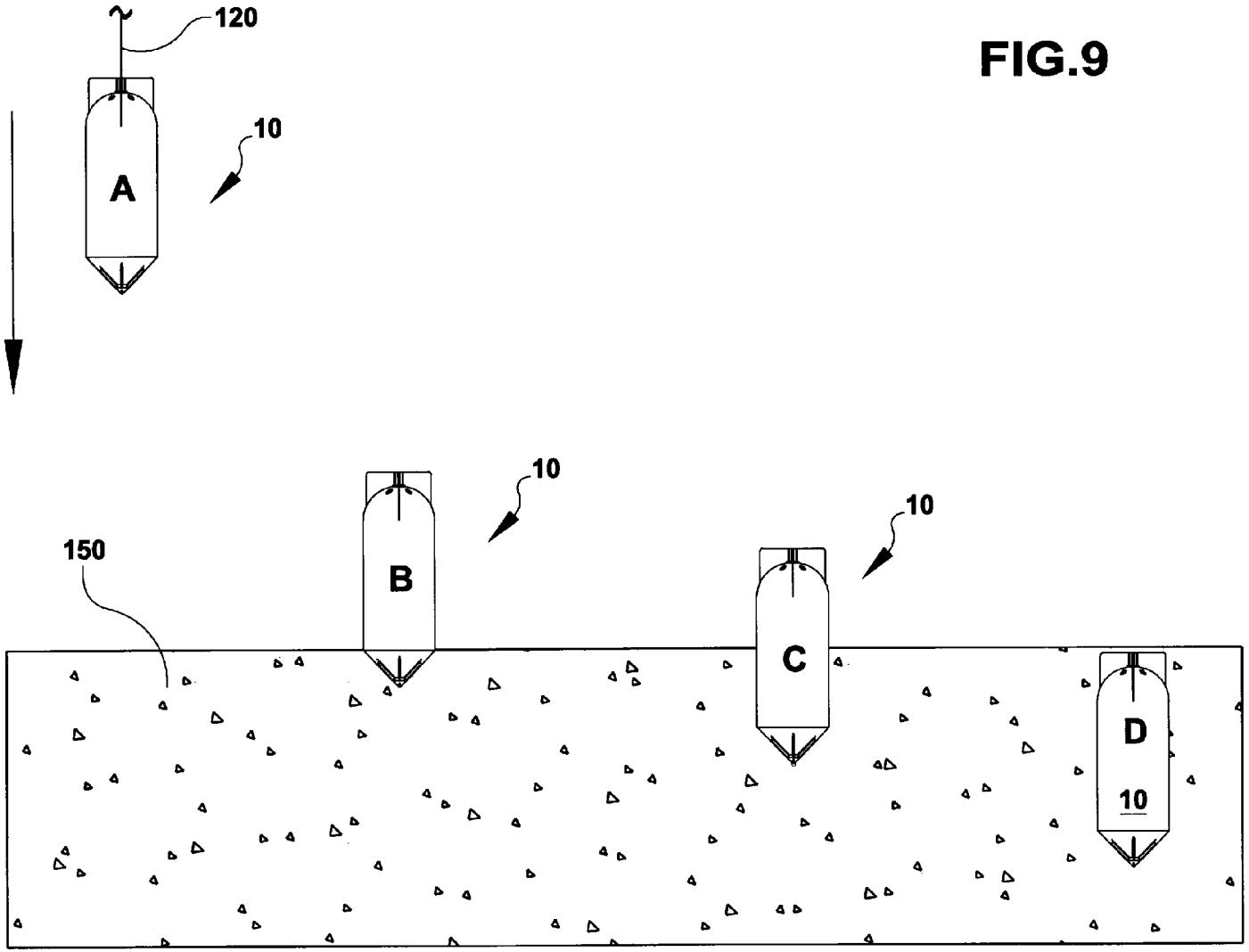
FIG. 9 shows a diagram illustrating the deployment of an embodiment of a system in accordance with the Self-Contained Burying Device for Submerged Environments, and the burying of the system into the sea floor.

FIG. 9 shows a diagram illustrating a method for deploying system 10, and the burying of the system 10 into the sea floor. As shown at time A, system 10 is tethered to an object, such as a buoy, floating vessel, submerged vessel, or aircraft, by tether 120. Tether 120 may be connected to rear portion 30. As an example, such connection may occur by securing tether 120 to either end cap 92 or directly to body portion 20. At time B, system 10 has been released from tether 120, causing system 10 to descend towards sea floor 150, as shown by the arrow. In some embodiments, the system is aided in its descent to sea floor 150 by a propellant. A system having such a propellant is discussed with reference to FIG. 10.

Prior to reaching sea floor 150, a remote operator of system 10 may remotely transmit a signal to circuitry 100, such signal causing circuitry 100 to activate vibratory device 50 and pump 60 such that system 10 may immediately commence burying once system 10 has reached sea floor 150. In other embodiments, a sensor may cause vibratory device 50 and pump 60 to activate based upon a certain event, such as system 10 reaching a predetermined depth at a known hydrostatic pressure.

At time C, system 10 has reached sea floor 150 and is engaged in burying into sea floor 150. A remote operator of system 10 may control the burying of system 10 such that system 10 is buried to a desired depth into sea floor 150. At time D, system 10 is completely buried in sea floor 150. At such point, operation of system 10 may be remotely stopped or may automatically stop based upon a signal received by circuitry 100 from an on-board sensor or programmed operation.

FIGS. 10A-10C show a perspective, side, and top view, respectively, of an embodiment of a system 200 containing a propellant attached thereto, in accordance with the Self-Contained Burying Device for Submerged Environments. System 200 may include a self-contained burying device 210 and a propellant 220. Embodiments of burying device 210 may be identical to embodiments of system 10 as discussed with reference to FIGS. 1-9 herein. In some embodiments, propellant 220 may be a propeller. In such embodiments, the propeller is attached to a drive shaft 230 and is powered by an electric motor (not shown). In some embodiments, the propeller is surrounded by a shroud 240 to protect the propeller blades. In other embodiments, propellant 220 may be a propellant powered by a combination of propellers, impellers or fins, compressed gas jets, and/or energy producing chemical reactions. In some embodiments, system 200 may include multiple propellants to allow the system to accelerate in all degrees of freedom to allow system 200 to navigate to a particular burial location within the marine environment.

Many modifications and variations of the Self-Contained Burying Device for Submerged Environments are possible in light of the above description. Within the scope of the appended claims, the Self-Contained Burying Device for Submerged Environments may be practiced otherwise than as specifically described. Further, the scope of the claims is not limited to the implementations and embodiments disclosed herein, but extends to other implementations and embodiments as may be contemplated by those having ordinary skill in the art.

We claim:

1. A self-contained burying system for submerged environments comprising:

a body portion configured to house a payload, the body portion having a rear portion having a fluid intake port and a nose portion having a fluid discharge port;

an omni-directional vibratory device contained within the body portion;

a pump contained within the body portion;

a fluid conduit contained within the body portion, the fluid conduit coupled to the pump and the fluid discharge port; and a power source contained within the body portion, the power source electrically connected to the omni-directional vibratory device and the pump.

2. The system of claim 1 further comprising two end caps rigidly fixed within the body portion, wherein the fluid conduit passes through each end cap.

3. The system of claim 1 further comprising control circuitry contained within the body portion.

4. The system of claim 1, wherein the omni-directional vibratory device and the pump are activated by a sensor connected thereto, wherein the sensor is selected from the group of sensors consisting of a hydrostatic pressure sensor, an accelerometer, and an altimeter.

5. The system of claim 1 further comprising communications circuitry contained within the body portion, wherein the omni-directional vibratory device and the pump are remotely controlled via the communications circuitry.

6. The system of claim 1, wherein the payload is a sensor system.

7. The system of claim 1, wherein the payload is a battery pack.

8. The system of claim 1, wherein the payload is a ballast for anchoring.

9. The system of claim 1, wherein the payload is shock mounted.

10. The system of claim 1 further comprising at least one fin coupled to the body portion.

11. The system of claim 1 further comprising a propellant coupled to the body portion.

12. The system of claim 1, wherein the body portion includes a non-perforated nose portion.

13. The system of claim 12, wherein the nose portion contains at least three fins, wherein the system further comprises a tip structure coupled to the at least three fins such that the tip structure is in alignment with and distanced from the fluid discharge port.

14. A self-contained burying system for submerged environments comprising:

a body portion having a first compartment and a second compartment, the second compartment configured to house a payload;

a rear portion coupled to the first compartment and in alignment with the body portion, the rear portion having at least one fluid intake port;

a non-perforated nose portion coupled to the second compartment and in alignment with the body portion, the nose portion having a fluid discharge port;

an omni-directional vibratory device contained within the first compartment;

a pump contained within the rear portion;

a fluid conduit contained within the body portion and the nose portion, the fluid conduit coupled to the pump and the fluid discharge port; and a power source contained within the body portion, the power source electrically connected to the omni-directional vibratory device and the pump.

15. The system of claim 14, wherein the nose portion contains at least three fins, wherein the system further comprises a tip structure coupled to the at least three fins such that the tip structure is in alignment with and distanced from the fluid discharge port.

16. The system of claim 14 further comprising two end caps rigidly fixed within the body portion, wherein the fluid conduit passes through each end cap.

17. The system of claim 14, wherein the payload is selected from the group of payloads consisting of a sensor system, a battery pack, and a ballast for anchoring.

18. The system of claim 14 further comprising communications circuitry and control circuitry contained within the body portion, wherein the omni-directional vibratory device and the pump are remotely controlled via the communications circuitry.

19. The system of claim 18, wherein the omni-directional vibratory device and the pump are configured to be activated by a sensor connected thereto, wherein the sensor is selected from the group of sensors consisting of a hydrostatic pressure sensor, an accelerometer, and an altimeter.

20. A self-contained burying system for submerged environments comprising:

a body portion configured to house a payload, the body portion having a rear portion having a fluid intake port and a nose portion having a fluid discharge port;

an omni-directional vibratory device contained within the body portion;

a pump contained within the body portion;

a fluid conduit contained within the body portion, the fluid conduit coupled to the pump and the fluid discharge port;

a power source contained within the body portion, the power source electrically connected to the omni-directional vibratory device and the pump;

communications circuitry contained within the body portion, wherein the omni-directional vibratory device and the pump are remotely controlled via the communications circuitry; and a sensor connected to the omni-directional vibratory device and the pump, wherein the omni-directional vibratory device and the pump are configured to be activated by the sensor.

* * * * *